United States Patent [19]

Hanmura et al.

[11] Patent Number: 4,481,511

[45] Date of Patent: Nov. 6, 1984

[54] MATRIX DISPLAY DEVICE

[75] Inventors: Hisao Hanmura, Hitachi; Masahiro Takasaka, Hitachiota, both of Japan

[73] Assignee: Hitachi, Ltd., Tokyo, Japan

[21] Appl. No.: 335,690

[22] Filed: Dec. 30, 1981

[30] Foreign Application Priority Data

Jan. 7, 1981 [JP] Japan ..... 56-347
Jan. 7, 1981 [JP] Japan ..... 56-378

[51] Int. Cl.[3] ..... G09G 3/20

[52] U.S. Cl. ..... 340/752; 340/765; 340/784; 340/799

[58] Field of Search ..... 340/765, 763, 752, 784, 340/802, 799; 350/333, 332

[56] References Cited

U.S. PATENT DOCUMENTS 4,231,640 11/1980 Funada et al. ..... 340/784
4,236,155 11/1980 Nagata ..... 340/765
4,321,598 3/1982 Warner ..... 340/752
4,335,937 6/1982 Takamatsu et al. ..... 340/784
4,359,729 11/1982 Nonomura et al. ..... 340/765

FOREIGN PATENT DOCUMENTS 120230 10/1978 Japan .
106189 8/1979 Japan .

*Primary Examiner*—Gerald L. Brigance
*Attorney, Agent, or Firm*—Antonelli, Terry & Wands

[57] ABSTRACT

Disclosed is a matrix display device comprising: a matrix display panel having a plurality rows of row electrodes and a plurality column of column electrodes and a display medium interposed therebetween, crosspoints of the row electrodes and the column electrodes defining picture cells arranged in matrix, each column of the column electrodes opposing to respective one column of the matrix picture cells being divided into a plurality of groups with a predetermined regularity and electrically interconnected within each group, terminals of at least two groups of column electrodes of the plurality of groups of column electrodes being arranged to extend to the same side of the matrix display panel; a row electrode drive circuit for producing row electrode drive signals to be applied to the row electrodes in accordance with a video data; a column electrode drive circuit for producing column electrode drive signals to be applied to the at least two groups of column electrodes in accordance with the video data; a video data circuit for supplying said video data to said row electrode drive circuit and said column electrode drive circuit.

In the device, the outputs of the column electrode drive circuit or the video data to be supplied to the column electrode drive circuit are arranged in the same order as the arrangement of the terminals of the at least two groups of column electrodes.

12 Claims, 20 Drawing Figures

MATRIX DISPLAY DEVICE

BACKGROUND OF THE INVENTION

The present invention relates to a matrix display device using a multiplex matrix display panel.

Various sorts of display cells for the matrix display device, such as liquid crystal cells, electrochromic cells, a plasma display, a fluorescent display tube, LED's, PLZT cells and electroluminescence cells, have been known. By way of example, the principle of a liquid crystal display device is illustrated in FIG. 1, in which the liquid crystal 103 is held between a pair of substrates 101 and 102 at least one of which is transparent, and a predetermined voltage is applied between transparent electrodes 104 and 105 formed on the opposing surfaces of the substrates 101 and 102 to cause an electrooptical change in liquid crystal molecules. The relation between an effective voltage applied across the transparent electrodes 104 and 105 and the amount of transmitted light is shown in FIG. 2, in which $V_S$ and $V_{NS}$ represent threshold voltages. In the liquid crystal matrix display device, picture cells defined at the crosspoints of the transparent electrodes 104 and 105 are generally arranged in matrix form and characters or graphic patterns are displayed by selecting the effective voltages applied to the respective picture cells.

In such a matrix display device, in order to fire a number of picture cells with a high contrast, a multiplex matrix system or an alternate multiplex matrix system has been proposed. By way of example, a multi-matrix or duplex matrix system display device is explained with reference to FIGS. 3 to 5. Configurations shown in FIGS. 3 and 5 are disclosed in Japanese patent application Laid-Open Nos. 120230/78 and 106189/79, respectively.

Referring to FIG. 3, numeral 100 denotes an image data circuit which comprises a video signal input terminal 1, an A-D converter 2 and a timing control circuit 3. Column electrode drive circuits 4 and 5 comprise line memories 41 and 51, latch registers 42 and 52 and modulators 43 and 53, respectively. Numeral 6 denotes a row electrode drive circuit. A matrix display panel 7 has an electrooptical effect material, such as a liquid crystal or an electroluminescence material, filled in between a pair of substrates 8 and 9. The first substrate 8 has I row electrodes $X_1$–$X_I$ and the second substrate 9 has J A-column electrodes $Y_{A1}$–$Y_{AJ}$ and J B-column electrodes $Y_{B1}$–$Y_{BJ}$. The column electrodes are electrically divided into two groups which form J display columns $Y_1$–$Y_J$. Accordingly, 2I rows by J columns of picture cells are defined at the crosspoints of the row electrodes, and the column electrodes with the i-th row electrode $X_i$ (i=1, 2, . . . I) being connected to the (2i−1) the row picture cell and the (2i)th row picture cell. The A-column electrode $Y_{Aj}$ of the i-th column $Y_j$ (j=1, 2, . . . J) is connected to the picture cells on the odd numbered rows ((2i−1)th row) and the B-column electrode $Y_{Bj}$ is connected to the picture cells on the even numbered rows ((2i)th row).

Referring to FIG. 4*a*, circled numerals under a video signal VD indicate row numbers of a scan line of the video signal.

The video signal VD as shown in FIG. 4*a* is applied to the video signal input terminal 1. The A-D converter 2 receives the video signal VD and a sampling clock $CP_1$ and converts the video signal VD to a digital signal SD in synchronism with the sampling clock $CP_1$. The timing control circuit 3 extracts a synchronizing signal from the video signal VD to generate the sampling clock $CP_1$, write clocks $CP_A$ and $CP_B$ and a strobe pulse STB for controlling the display device.

The line memory 41 receives the digital video signal SD and the write clock $CP_A$ which is generated at the odd row period of the scan line and serially stores one scan line of video data in synchronism with the clock $CP_A$. The line memory 51 receives the digital video signal SD and the write clock $CP_B$ which is generated at the even row period of the scan line and stores one scan line of video data in synchronism with the clock $CP_B$. Accordingly, the odd rows of the scan line of video data are written into the line memory 41 while the even rows of the scan line of video data are written into the line memory 51. As shown in FIG. 4*a*, the first row of the scan line of video data is first written into the line memory 41 and then the second row of the scan line of video data is written into the line memory 51.

The strobe pulse STB is generated when the even rows of the scan line of video data have been written into the line memory 51. The latch registers 42 and 52 receive the video data stored in the line memories 41 and 51, respectively, and the strobe pulse STB and parallelly latch the video data from the line memories 41 and 51, respectively, in synchronism with STB.

The modulator 43 receives the odd rows of the scan line of video data latched in the latch register 42 and supplies column electrode drive signals $V_{YAj}$ (j=1, 2, . . . J) to the column electrodes $Y_{Aj}$ for modulating the brightnesses of the picture cells. Similarly, the modulator 53 receives the even rows of the scan line of video data latched in the latch register 52 and supplies column electrode drive signal $V_{YBj}$ to the column electrodes $Y_{Bj}$.

The row electrode drive circuit 6 receives the strobe pulse STB and supplies row electrode drive signals $V_{Xi}$ (i=1, 2, . . . I) to the row electrodes $X_i$. The row electrode drive signals $V_{Xi}$ are generated in such a manner that only one of the row electrodes $X_i$ is selected and other row electrodes are not selected at a time and the row electrodes $X_i$ are sequentially selected one at a time in synchronism with the strobe pulse STB.

Specific waveforms of the row electrode drive signal $V_{Xi}$ and the column electrode drive signals $V_{YAj}$ and $V_{YBj}$ vary depending on particular electrooptical material used as the display medium.

The row electrode drive signal $V_X$ and the column electrode drive signal $V_Y$ for the liquid crystal display medium are shown in FIG. 4*b*. A constant a is selected to be equal to or close to $\sqrt{I}+1$ where I is the number of the row electrodes $X_i$, and $V_o$ is a maximum amplitude of a voltage $V_x-V_y$ applied to the picture cell. The voltage $V_o$ is selected to meet the following relation:

$$a\sqrt{\frac{I}{I+(a^2-1)}}\,V_{TH}<V_o<a\sqrt{\frac{I}{I+\{(a-2)^2-1\}}}\,V_{TH}$$

where $V_{TH}$ is a threshold voltage of the liquid crystal.

Each of the scan electrodes $X_i$ is selected in every I-th cycle. The brightness of the picture cell is determined by a ratio $T_A/T$ of the column electrode drive signal $V_Y$. When $T_A=T$, the brightness of the picture cell is maximum, and when $T_A=0$ it is minimum. Accordingly, by controlling the ratio $T_A/T$, tone of the displayed image can be controlled.

Referring to FIG. 4*a*, the video data written into the line memories 41 and 51 at the first and second rows of the scan line of video signal VD, respectively, are transferred to the latch registers 42 and 52 in response to the strobe pulse STB generated at the end of the second row of the scan line and modulated into the column electrode drive signals $V_{YAj}$ and $V_{YBj}$ by the modulator 43 and 53 so that the first and second rows of the video data are supplied to the column electrodes $Y_{Aj}$ and $Y_{Bj}$. During this period, the third and fourth rows of the scan line of video signal VD are written into the line memories 41 and 51 as the next video data. The row electrode drive circuit 6, at this time, generates the row electrode drive signal $V_{Xi}$ to select the first row electrode $X_1$ so that the first and second rows of the picture cells on the column $Y_1$ are fired.

At the end of the fourth column of the scan line of video signal VD, the strobe pulse STB is again generated and the column electrode drive signals $V_{YAj}$ and $V_{YBj}$ drive the third and fourth rows of the video signal VD and the row electrode drive signal $V_{Xi}$ selects the second row electrode $X_2$ so that the third and fourth rows of the picture cells on the column $Y_i$ are fired. Similar operations are repeated to fire other picture cells.

FIG. 5 shows a prior art example in which lead terminals of the column electrodes $Y_{Aj}$ and $Y_{Bj}$ and the column electrode circuits 4 and 5 are collected on one side of the one substrate 9 of the matrix display panel 7 in order to reduce the size of the device shown in FIG. 3. In FIG. 5, the like numerals to those of FIG. 3 denote like elements.

As shown in FIG. 5, where the terminals of the different column electrodes $Y_{Aj}$ and $Y_{Bj}$ are arranged on the same side of the matrix display panel 7, the signal lines of the column electrodes $Y_{Aj}$ and $Y_{Bj}$ and the column electrode drive circuits 4 and 5 cross each other. Accordingly, they cannot be wired by a flat cable, but a multi-layer printed circuit board is required, which results in the increase of the manufacturing cost.

SUMMARY OF THE INVENTION

It is an object of the present invention to provide a matrix display device in which connecting lines of the column electrodes and the column electrode drive circuits do not cross so that the wiring is facilitated.

In accordance with a feature of the matrix display device of the present invention, the column electrodes opposing a line of picture cell matrix of the matrix display panel are electrically divided into a plurality of groups with a predetermined regularity for each column, and terminals of the column electrodes of at least two of the plurality of groups of column electrodes are arranged to extend to the same side of the matrix display panel, and the column electrode terminals of the at least two groups of the column electrodes on the same side are arranged in the same order or sequence as that of the output terminals of the column electrode drive circuits.

In accordance with another feature of the matrix display device of the present invention, the column electrodes opposing a line of picture cell matrix of the matrix display panel are electrically divided into a plurality of groups with a predetermined regularity for each column, the terminals of at least two groups of the plurality of groups of column electrodes are arranged on the same side of the matrix display panel, the column electrodes of the two groups arranged on the same side are connected to the column electrode drive circuits, and the order of the video data arrangement supplied from a video data circuit to the column electrode drive circuits is same as the order of arrangement of the terminals of the two groups of column electrodes arranged on the same side of the matrix display panel.

The predetermined regularity in electrically dividing the column electrodes into the plurality of groups means that when the column electrodes are divided by four times the number of row electrodes to define four rows of picture cells for each row electrode and divide the column electrodes into groups a, b, c and d, the groups are regularly arranged in the order of a, b, c, d, a, b, c, d, . . . (multiplex system) or a, b, c, d, d, c, b, a, a, b, c, d, . . . (alternate multiplex system).

The order of arrangement of the outputs of the column electrode drive circuit and the order of the arrangement of the video data supplied from the video data circuit to the column electrode drive circuit and the order of the arrangement of the terminals of the column electrodes of the at least two groups of column electrodes arranged on the same side of the matrix display panel are same. This means that when the column electrodes are divided into quadruplex groups and all of the terminals of the column electrodes are arranged on the same side of the matrix display panel with the order of a, b, c, d (for the first column), a, b, c, d (for the second column) and so on, the order of the arrangement of the outputs of the column electrode drive circuit and the order of storing the video data in the line memory of the column electrode drive circuit are Ia, Ib, Ic, Id (for the first column), Ia, Ib, Ic, Id (for the second column) and so on.

The other objects and the features of the present invention will be apparent from the following description of the preferred embodiments.

DESCRIPTION OF THE PREFERRED EMBODIMENTS

The present invention will now be explained in detail in conjunction with the preferred embodiments.

EMBODIMENT 1

Figure 6:
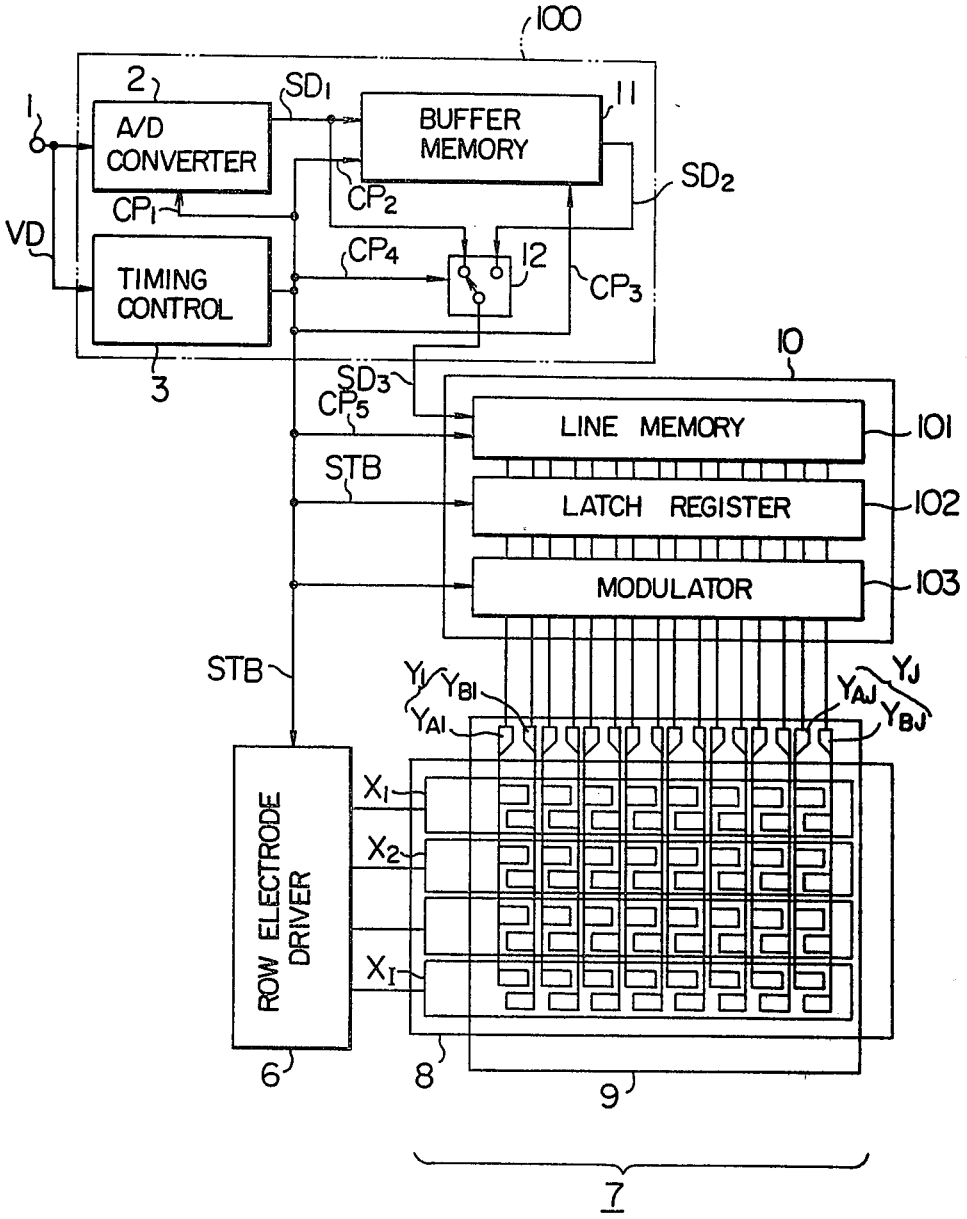
FIG. 6 shows a first embodiment of a liquid crystal matrix display device in accordance with the present invention.

Referring to FIG. 6, a video data circuit 100 comprises an A-D converter 2, a timing control circuit 3, a buffer memory 11 and a switch 12. A column electrode driver 10 comprises a line memory 101, a latch register 102 and a modulator 103, and has 2J output lines so that it can drive both A-column electrodes $Y_{Aj}$ and B-column electrodes $Y_{Bj}$.

The timing control circuit 3 generates a sampling clock $CP_1$, a buffer memory write clock $CP_2$, a buffer memory read clock $CP_3$, a switching clock $CP_4$, a line memory write clock $CP_5$ and a strobe pulse STB.

The buffer memory 11 receives a digital video signal $SD_1$, the buffer memory write clock $CP_2$ and the buffer memory read clock $CP_3$ and sequentially stores a scan line of video data in synchronism with $CP_2$ and sequentially outputs the stored scan line of video data in synchronism with $CP_3$. The digital video signal outputted from the buffer memory 11 is represented by $SD_2$.

The switch 12 receives the digital video signals $SD_1$ and $SD_2$ and the switching clock $CP_4$ and outputs two scan lines of video data $SD_1$ and $SD_2$ as a digital video signal $SD_3$.

Figure 7:
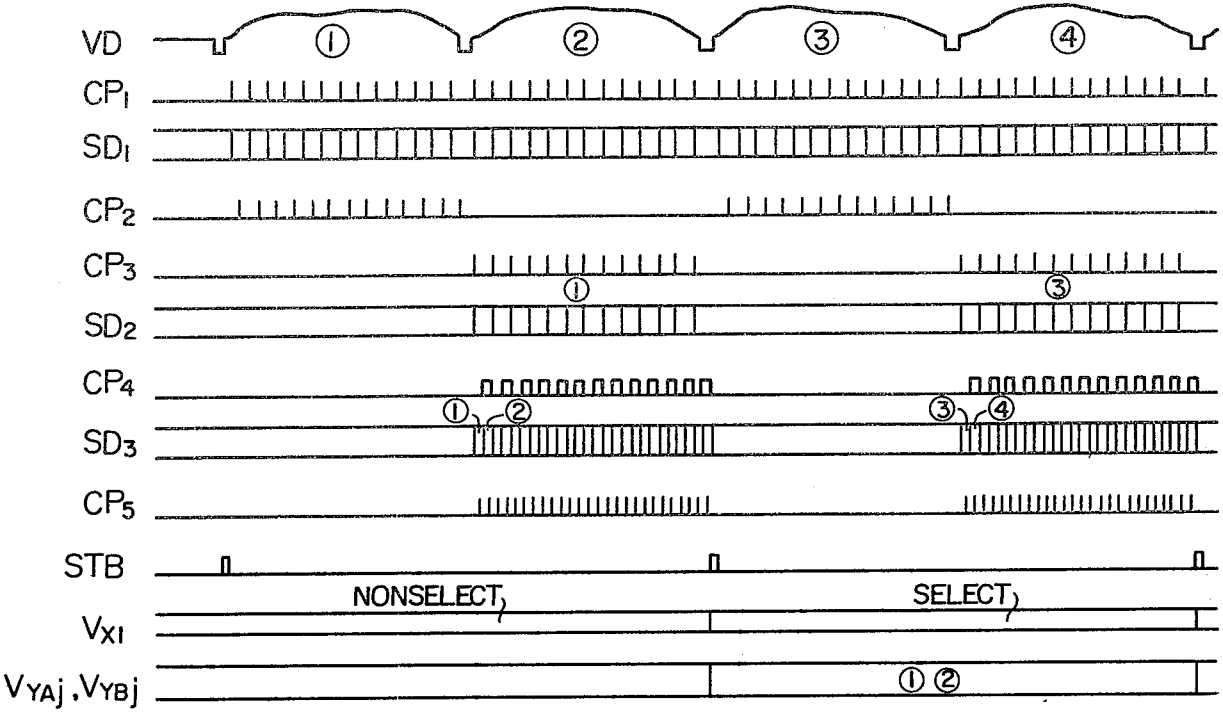
FIG. 7 shows a time chart for the operation of the first embodiment.

Referring to FIG. 7, the buffer memory write clock $CP_2$ is generated at every odd row period of the scan line so that odd rows of the scan line of video data are stored in the buffer memory 11 in synchronism with $CP_2$. The buffer memory read clock $CP_3$ is generated at every even row period of the scan line so that the digital video signal $SD_2$ is outputted such that the first row of video data is produced in the second row period of the scan line, the third row of video data is produced at the fourth row period, and the (2i−1)th row video data is produced at the (2i)th row period.

The switch 12 receives the digital video signals $SD_1$ and $SD_2$ and the switching clock $CP_4$ and alternately selects $SD_1$ and $SD_2$ in the even row period of the scan line to produce $SD_3$. Accordingly the digital video signal $SD_3$ includes two scan lines of video data in each even row of the scan line. The switch 12 is controlled by the switching clock $CP_4$ and $SD_2$ is first applied thereto. Accordingly, the digital video signal $SD_3$ alternately provides the odd rows and even rows of the video data with the odd rows of the scan line of video data being provided first. This sequence corresponds to the sequence of connection of the column electrodes of the matrix display panel 7 to the column electrode driver 10 in which the column electrodes are arranged in $Y_{A1}$, $Y_{B1}$, . . . with the electrodes with suffix A appearing first.

In FIG. 6, the line memory 101 in the column electrode driver 10 receives the digital video signal $SD_3$ and the line memory write clock $CP_5$ and sequentially stores $SD_3$ in synchronism with $CP_5$. As shown in FIG. 7, the line memory write clock $CP_5$ is generated in the even row period of the scan line of video signal VD and the frequency thereof is twice as high as that of the conventional system so that two lines of video data can be written into the line memory 101 in one scan line period.

Figure 4B:
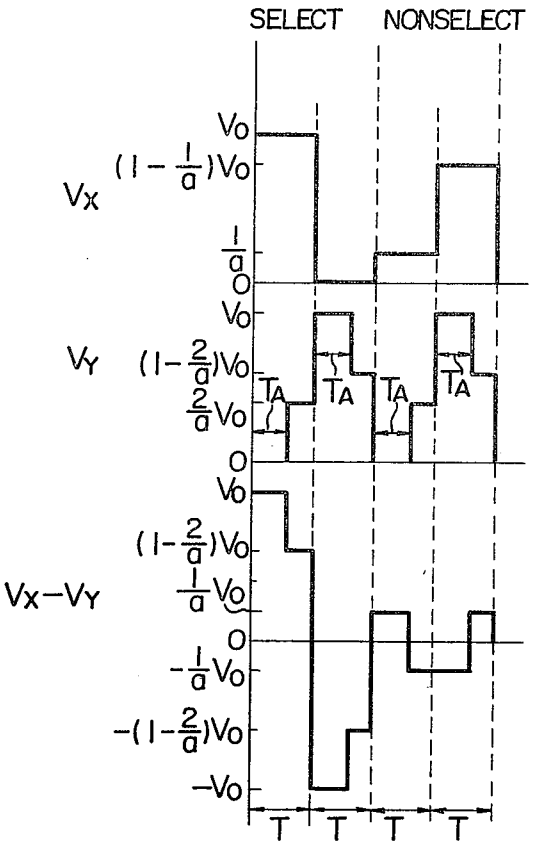
FIG. 4*b* shows drive signals used in the circuit of FIG. 3.
Figure 1:
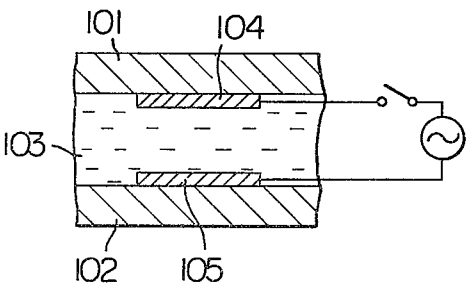
FIG. 1 illustrates a principle of a liquid crystal display.
Figure 2:
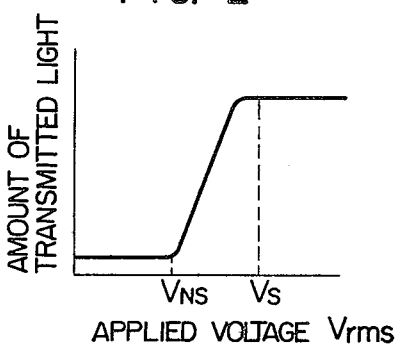
FIG. 2 shows a relation between an applied voltage and the amount of transmitted light in operating a liquid crystal display device.
Figure 3:
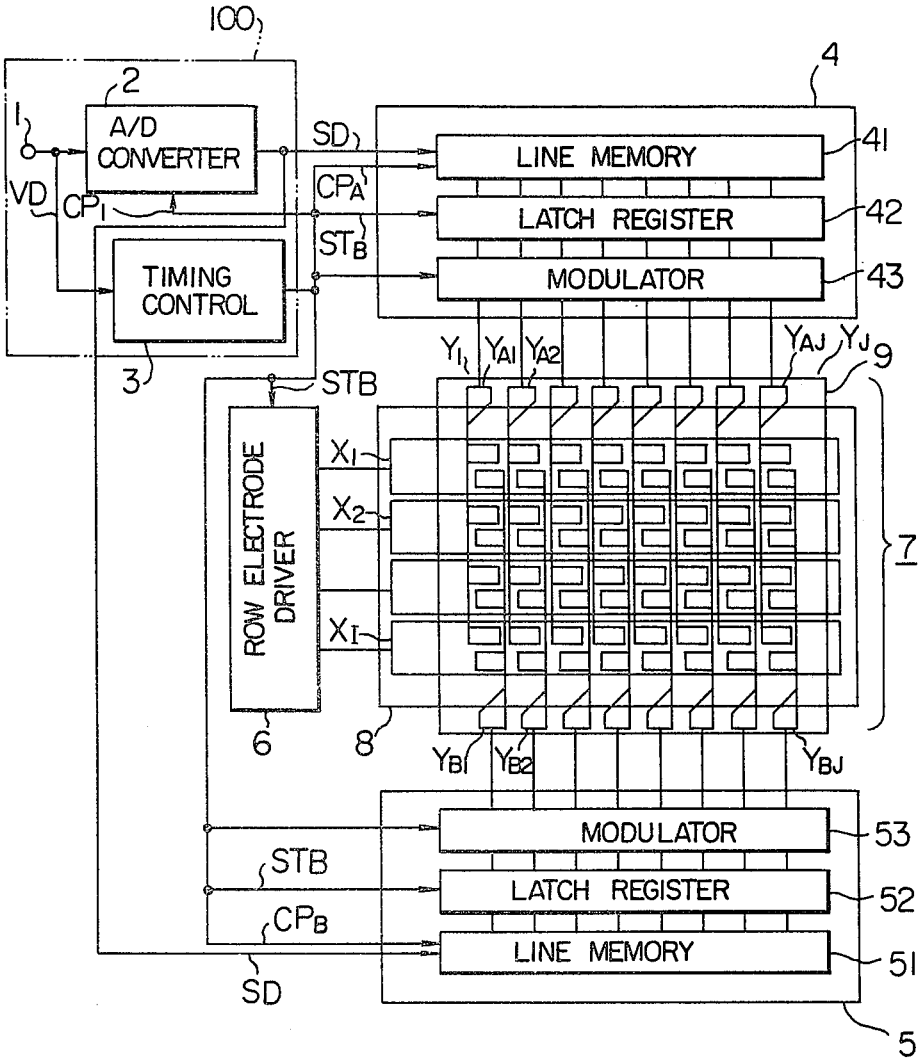
FIG. 3 PRIOR ART
FIG. 3 shows an example of a prior art liquid crystal matrix display device.
Figure 4A:
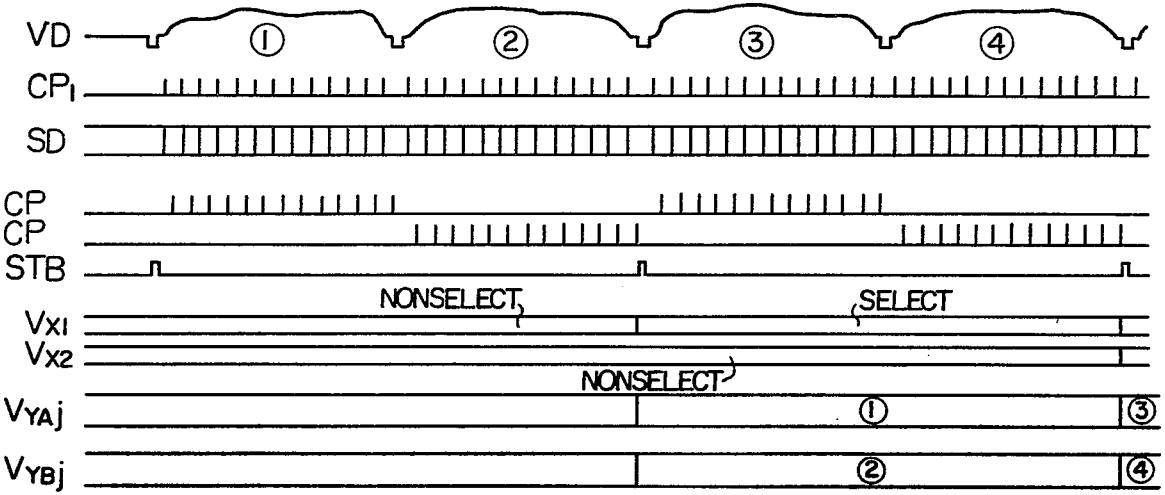
FIG. 4a PRIOR ART
FIG. 4*a* shows a time chart for the operation of the circuit of FIG. 3.
Figure 5:
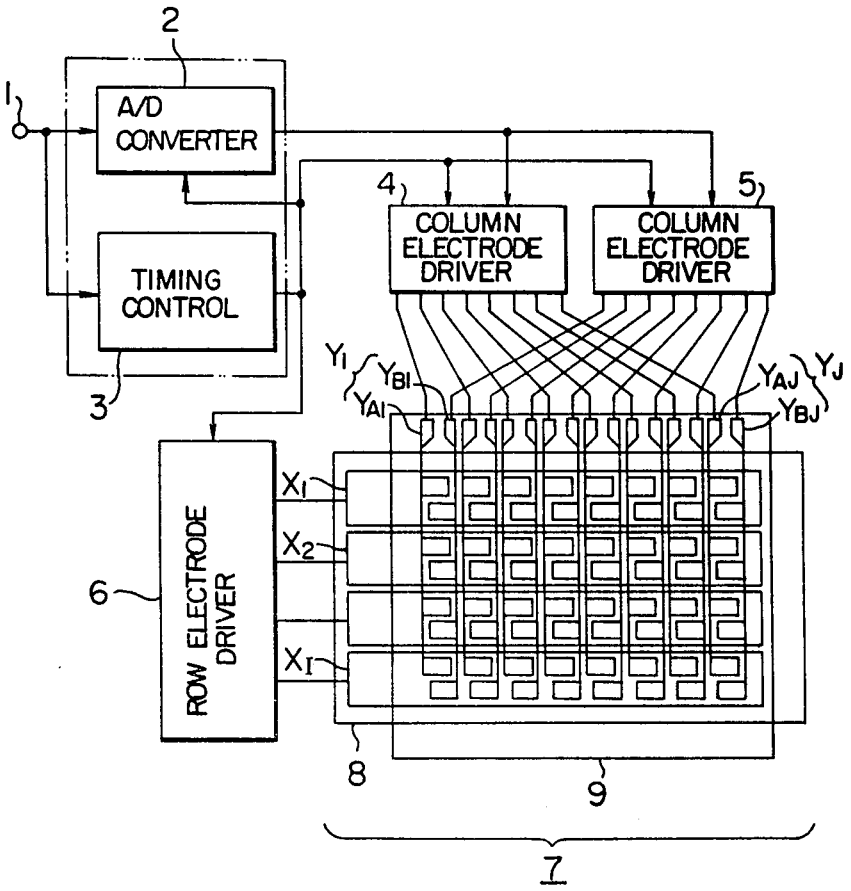
FIG. 5 PRIOR ART
FIG. 5 shows another example of a prior art liquid crystal matrix display device.

The latch register 102 and the modulator 103 each has 2J internal circuits which are twice as many as those of the conventional systems shown in FIGS. 3 and 5. The other aspects are identical to the conventional system. The latch register 102 latches the video data of the line memory 101 in synchronism with the strobe pulse STB and converts them to the column electrode drive signals $V_{YAj}$ and $V_{YBj}$.

The matrix display panel of the present invention employs a double matrix system in which all of the column electrodes are driven from the same side of the substrate. That is, the terminals of the A-column electrodes $Y_{A1-YAJ}$ and the B-column electrodes $Y_{B1}$–$Y_{BJ}$ are arranged on one side of the substrate with the A-column electrodes and the B-column electrodes being alternately arranged in the order such as $Y_{A1}$, $Y_{B1}$, $Y_{A2}$, $Y_{B2}$, . . . $Y_{AJ}$, $Y_{BJ}$. The 2J column electrode drive signals at the outputs of the modulator 103 of the column electrode driver 10 are applied to the 2J column electrodes without changing the order.

In the present device, since the odd rows of the scan line of video data and the even rows of the scan line of video data are alternately written in the line memory 101, the drive signals $V_{YAj}$ for the odd rows of the scan line are applied to the respective A-column electrodes $Y_{Aj}$ and the drive signals $V_{YBj}$ for the even rows of the scan line are applied to the B-column electrodes $Y_{Bj}$ so that the wirings between the column electrodes $Y_{Aj}$ and $Y_{Bj}$ and the column electrode drive 10 do not cross.

In the present embodiment, since the column electrodes connected to the picture cells on the odd rows of the display columns and the column electrodes connected to the picture cells on the even rows are alternately arranged, the order of the video data written into the line memory is selected such that the odd rows of the scan line of video data and the even rows of the scan line of video data alternate.

EMBODIMENT 2

Figure 8:
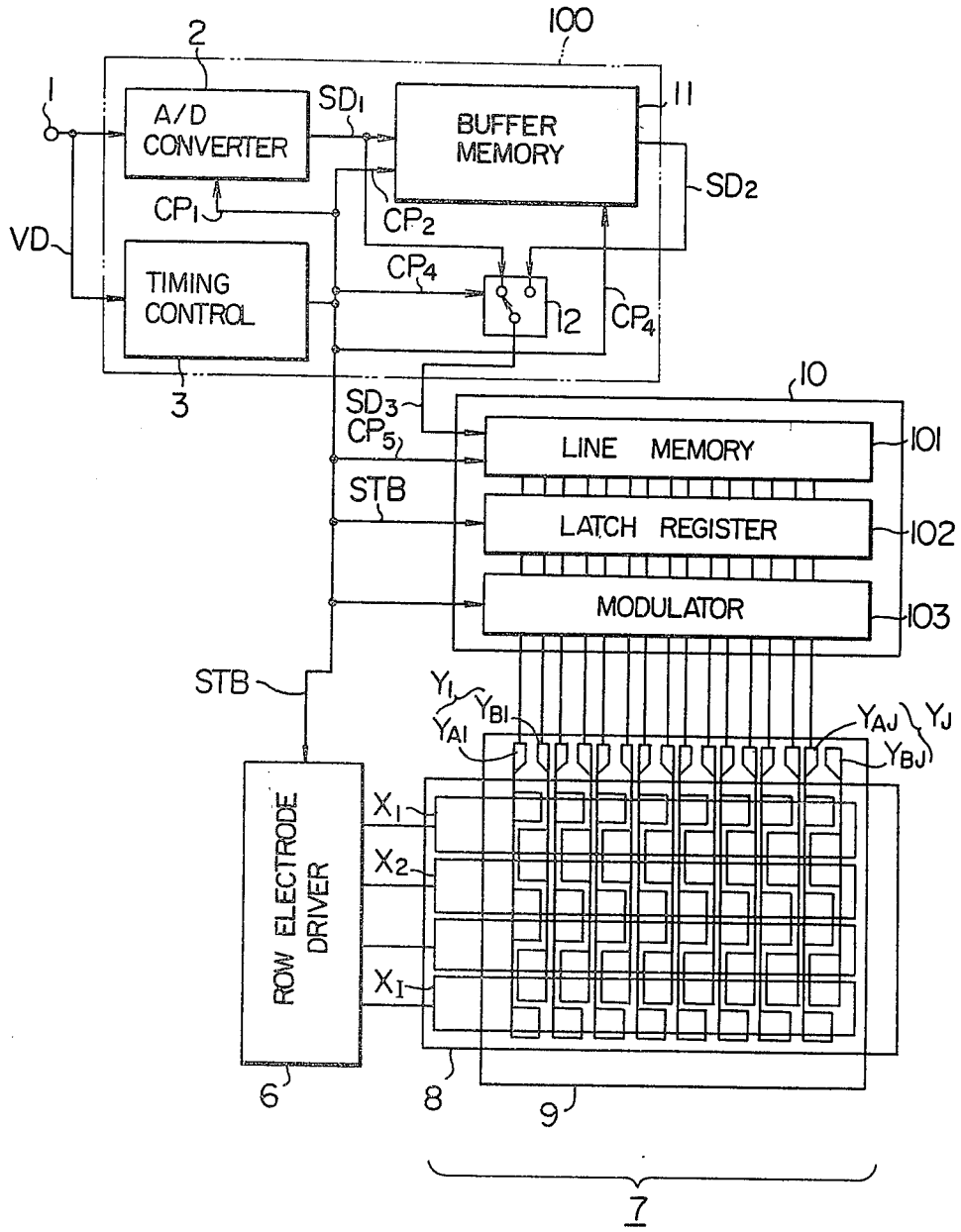
FIG. 8 shows a second embodiment of the liquid crystal matrix display device in accordance with the present invention.

Referring to FIG. 8, it is identical to FIG. 6 except for the matrix display panel 7.

The picture cells in FIG. 8 have 2I rows and J columns as is the case of FIG. 6 and the first substrate 8 and the row electrodes formed thereon are also identical to those of FIG. 6. There are I row electrodes which are designated by $X_1$, $X_2$, . . . $X_i$, . . . $X_I$. The row electrode $X_i$ are connected to the picture cells on the (2i−1)th row and the picture cells on the (2i)th row, like in FIG. 6.

On the second substrate 9, there are formed J A-column electrodes and J B-column electrodes, which are designated by $Y_{A1}$, $Y_{A2}$, . . . $Y_{Aj}$, . . . $Y_{AJ}$ and $Y_{B1}$, $Y_{B2}$, . . . $Y_{Bj}$, . . . $Y_{BJ}$, as is the case of FIG. 6.

The manner of connection of the column electrodes to the picture cells is different from that of FIG. 6. The A-column electrodes $Y_{Aj}$ are connected to the picture cells in the odd rows of the display columns $Y_j$ at the crosspoints with the odd row electrodes $X_{2m-1}$ (m=1, 2, . . . I/2), and connected to the picture cells on the even rows at the crosspoints with the even row electrodes $X_{2m}$ (m=1, 2, . . . I/2). For example, the A-column electrode $Y_{A1}$ is connected to the picture cell on the first row at the crosspoint with the row electrode $X_1$, and connected to the picture cell on the fourth row at the crosspoint with the row electrode $X_2$.

The B-column electrodes $Y_{Bj}$ are connected to the picture cells on the even rows of the display columns $Y_j$ at the crosspoints with the odd row electrodes $X_{2m-1}$ (m=1, 2, . . . I/2), and connected to the picture cells on the odd rows of the display columns $Y_j$ at the crosspoints with the even row electrodes $X_{2m}$ (m=1, 2, . . . I/2). For example, the B-column electrode $Y_{B1}$ is connected to the picture cell on the second row at the crosspoint with the row electrode $X_1$ and connected to the picture cell on the third row at the crosspoint with the row electrode $X_2$.

Thus, the A-column electrodes $Y_{Aj}$ and the B-column electrodes $Y_{Bj}$ are connected to the picture cells on the odd rows of the display columns $Y_j$ at certain crosspoints and connected to the picture cells on the even rows at other crosspoints. The present invention is applicable to such a system. No reconfiguration of the device is necessary. The configuration of the present embodiment is identical to that of FIG. 6 except the matrix display panel which is shown in FIG. 8.

A difference between the present embodiment and that of FIG. 6 resides in the manner in which the switch 12 is operated. The operation of the present embodiment is explained below with reference to FIG. 9.

Figure 9:
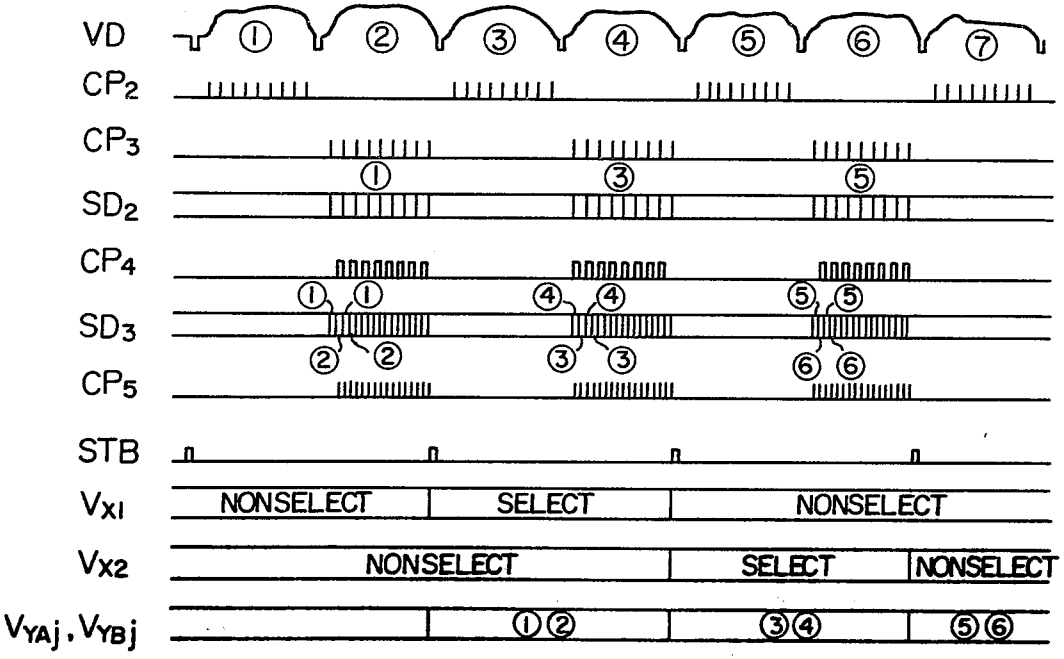
FIG. 9 shows a time chart for the operation of the second embodiment.

In the present embodiment, the sampling pulse $CP_1$ and the digital video signal $SD_1$ are generated during the scan line period like in the case of FIG. 7 and they are omitted in FIG. 9. The buffer memory write clock $CP_2$, the buffer memory read clock $CP_3$ and the digital video signal $SD_2$ are also identical to those shown in FIG. 7, and the buffer memory 11 stores the odd rows of the scan line of video data and outputs $SD_2$ during the even row periods of the scan line.

The switch 12 is controlled by the switching clock $CP_4$. In the second row period of the scan line, it alternately selects the digital video signals $SD_1$ and $SD_2$ and outputs the digital video signal $SD_3$ having twice number of data like in the case of FIG. 7. The switching sequence is identical to that of FIG. 7, that is, the first row of the scan line of video data, $SD_2$, is produced at the beginning of $SD_3$, and then the second row of the scan line of video data, $SD_2$, is produced next.

The signals applied to the column electrode driver 10 and the row electrode driver 6 and the operations of those circuits are identical to those in FIGS. 6 and 7. Accordingly, as shown in FIG. 9, the row electrode $X_1$ is selected between the third and fourth row periods of the scan line, and the column electrode drive signals $V_{YAj}$ and $V_{YBj}$ corresponding to the first and second rows of the scan lines are applied to the column electrodes $Y_{Aj}$ and $Y_{Bj}$. At the same time, the column electrode drive signals $V_{YAj}$ and $V_{YBj}$ corresponding to the first row and second row of the scan line of video data are applied to the A-column electrode $Y_{Aj}$ and the B-column electrode $Y_{Bj}$, respectively.

On the other hand, in the fourth row period of the scan line, the clock $CP_4$ is different from that in the second row period of the scan line so that the switch 12 first selects the fourth row of the video data, $SD_1$, and then selects the third row of the video data, $SD_2$. The digital video signal $SD_3$ thus produced is written into the line memory 101 and converted to the column electrode drive signals $V_{YAj}$ and $V_{YBj}$ between the fifth and sixth row periods of the scan line, and those signals are applied to the column electrodes $Y_{Aj}$ and $Y_{Bj}$. At this time, the second row electrode $X_2$ is in a selected state, and the column electrode drive signals $V_{YAj}$ and $V_{YBj}$ corresponding to the fourth row and third row of the video data are applied to the A-column electrode $Y_{Aj}$ and the B-column electrode $Y_{Bj}$, respectively. Referring to the matrix display panel shown in FIG. 8, the data corresponding to the third row of the scan line is displayed on the picture cells on the third row of the display column $Y_j$ while the second row electrode $X_2$ is selected, and the data corresponding to the fourth row of the scan line is displayed on the picture cells on the fourth row of the display column $Y_j$. The display operations for the fifth and following rows are repetitions of those for the first to fourth rows.

The feature of the present embodiment resides in that the order of writing the video data into the line memory is changed for each scan line depending on the opposing status of the row electrode and the column electrode.

In the present embodiment, since the order of the arrangement of the terminals of the column electrodes of the matrix display panel coincides with the order of the arrangement of the outputs of the column electrode driver, the signal connecting lines for the column electrodes and the column electrode driver do not cross.

EMBODIMENT 3

Figure 10:
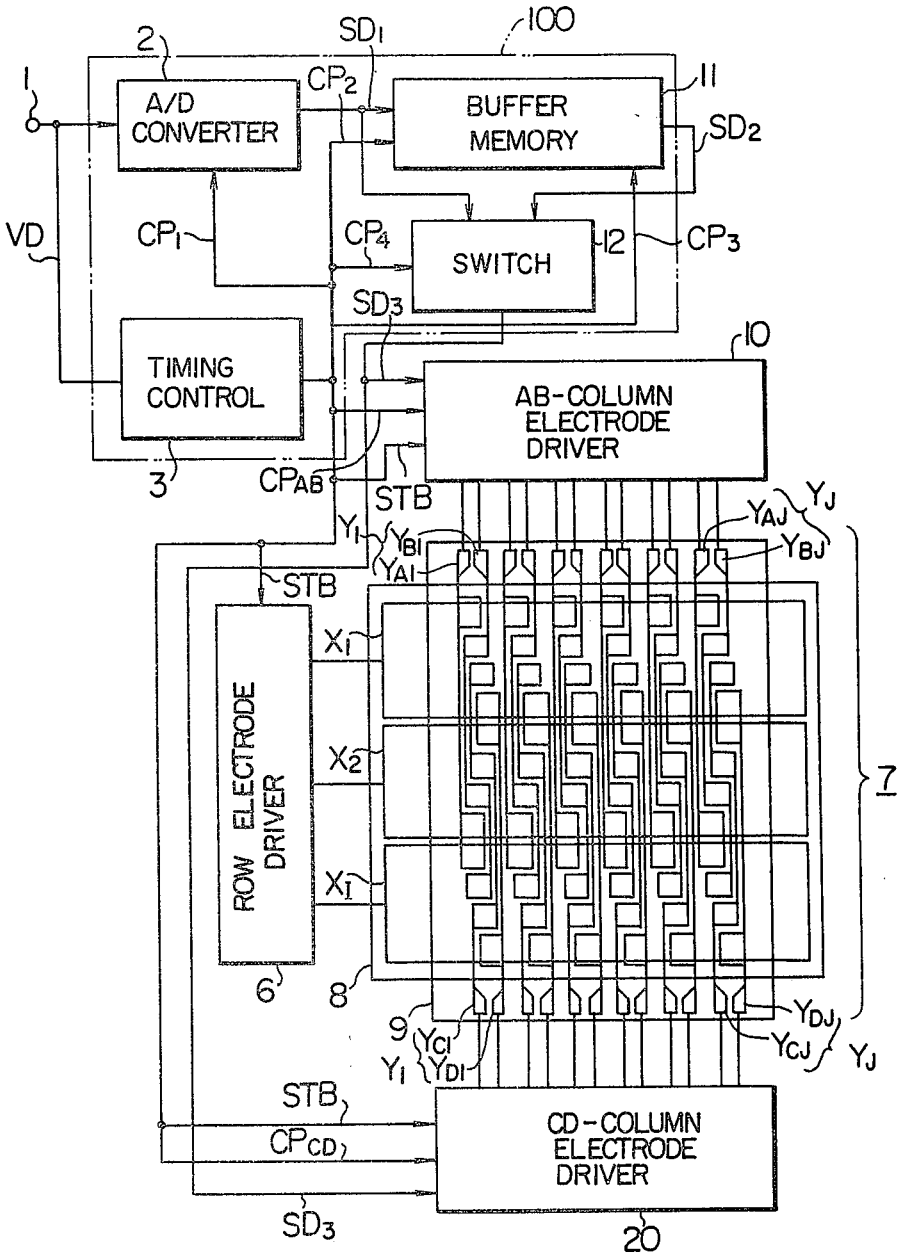
FIG. 10 shows a third embodiment of the liquid crystal matrix display device in accordance with the present invention.
Figure 11:
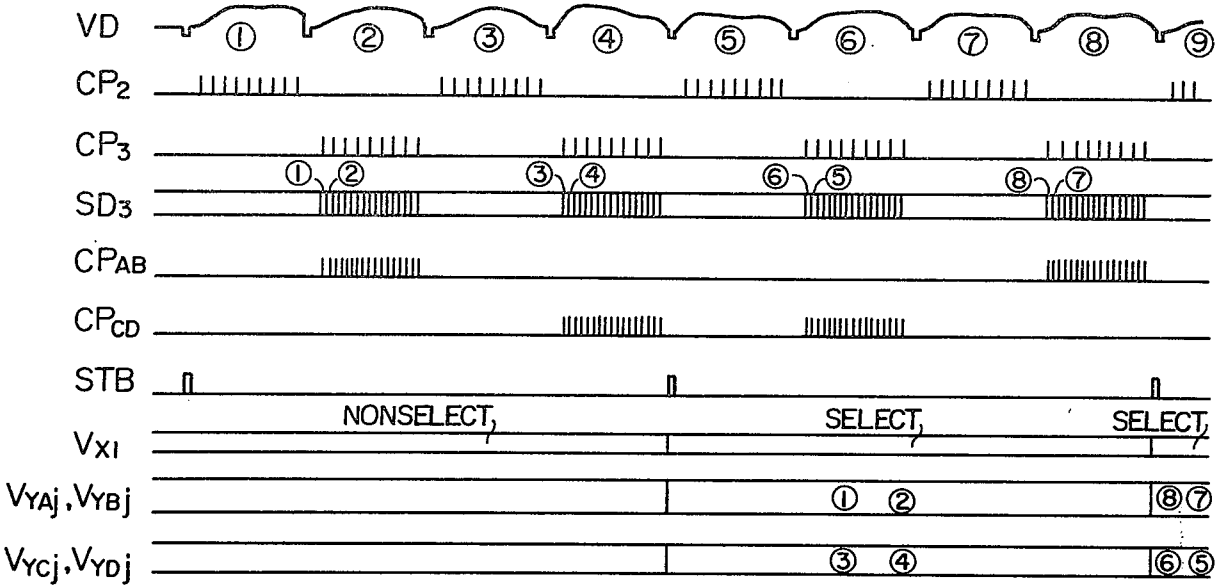
FIG. 11 shows a time chart for the operation of the third embodiment.

FIGS. 10 and 11 illustrate a third embodiment in which the present invention is applied to an alternate quadruplex matrix display device. In those figures, the like numerals to those shown in FIGS. 6 through 9 denote the corresponding elements.

In the alternate quadruplex matrix display panel 7, four rows of picture cells oppose each row electrode $X_i$ (i=1, 2, . . . I). The column electrode of each display column $Y_j$ (j=1, 2, . . . J) is divided into four groups to define A-column electrodes $Y_{Aj}$, B-column electrodes $Y_{Bj}$, C-column electrodes $Y_{Cj}$ and D-column electrodes $Y_{Dj}$. In FIG. 10, the picture cells opposing to the adjacent row electrodes, for example, $X_1$ and $X_2$, are connected in such a manner that the picture cells which define the first row opposing $X_1$ (first row of picture cells) and the picture cells which define the last row opposing $X_2$ (eighth row of picture cells) are connected to the A-column electrodes $Y_{Aj}$ (j=1, 2, . . . J), the picture cells which define the second row opposing $X_1$(second row of picture cells) and the picture cells which define the next to the last row opposing $X_2$ (seventh row of picture cells) are connected to the B-column electrodes $Y_{Bj}$, the third and sixth rows of picture cells are connected to the C-column electrodes $Y_{Cj}$, and the fourth and fifth rows picture cells are connected to the D-column electrodes $Y_{Dj}$. With this arrangement, a three dimensional wiring or detoured wiring is not necessary in connecting the picture cells (column electrodes) in the quadruplex matrix display panel.

In the matrix display panel 7 of the present embodiment, 4I rows by J columns of picture cells are defined.

The A-column electrodes $Y_{Aj}$ and the B-column electrodes $Y_{Bj}$ are arranged on one side of the first substrate 9 of the matrix display panel 7 and connected to the AB-column electrode driver 10, and the C-column electrodes $Y_{Cj}$ and the D-column electrodes $Y_{Dj}$ are arranged on the other side of the first substrate 9 and connected to a CD-column electrode driver 20. The line memory write clocks generated by the timing control circuit 3 include $CP_{AB}$ and $CP_{CD}$ which are supplied to the AB-column electrode driver 10 and the CD-column electrode driver 20. The other elements in FIG. 10 are identical to those of FIG. 6.

FIG. 11 illustrates the operation of the third embodiment of the present invention.

The sampling clock $CP_1$ and the digital video signal SD are generated during each row period of the scan line as they are generated in the first and second embodiments, and they are omitted in FIG. 11. Like in the first and second embodiments, the buffer memory write clock $CP_2$ is generated at each odd row ((2n−1)th row, where n=1, 2, . . . 2I) period of the scan line and the buffer memory read clock $CP_3$ is generated at each even row ((2n)th row) period of the scan line. Accordingly, the digital video signal $SD_2$ from the output of the buffer memory 11 is generated at the even row ((2n)th rows) periods of the scan line and comprise the odd rows ((2n−1)th rows) of the scan line of video data. $SD_2$ is omitted in FIG. 11.

The switch 12 receives the digital video signals $SD_1$ and $SD_2$ and the switching clock $CP_4$ and alternately selects $SD_1$ and $SD_2$ in the even row periods of the scan line in synchronism with the switching clock $CP_4$ to produce the digital video signal $SD_3$.

Considering the first to eighth rows of the scan line, in the second row period of the scan line the first row of the scan line of video data appears first in $SD_3$ and the second row of the scan line of video data follows. In the fourth row period of the scan line the third row of the scan line of video data appears first in $SD_3$ and the fourth row of the scan line of video data follows. On the other hand, in the sixth and eighth row periods of the scan line, the even rows, that is, the sixth and eighth rows of the scan line of video data appear first in $SD_3$ and the odd rows, that is, the fifth and seventh rows of the scan line of video data follow.

The line memory write clock $CP_{AB}$ is first generated at the second row period of the scan line so that the first and second rows of the video data produced in the second row period are written into the line memory of the AB-column electrode driver 10 by the digital video signal $SD_3$. The line memory write clock $CP_{CD}$ is first generated at the fourth row period of the scan line so that the third and fourth rows of the video data produced in the fourth row period are written into the line memory of the CD-column electrode driver 20 by the digital video signal $SD_3$.

In the present embodiment, the strobe pulse STB is generated when the first to fourth rows of the scan line of video data have been written into the line memories so that the video data is latched and the first row electrode $X_1$ is selected in the fifth to eighth row periods of the scan line. The video data are modulated into the column electrode drive signals $V_{YAj}$, $V_{YBj}$, $V_{YCj}$ and $V_{YDj}$ by the modulator, and the first row of the scan line of video data is supplied to the A-column electrodes $Y_{Aj}$, the second row of the scan line of video data is supplied to the B-column electrodes $Y_{Bj}$, the third row of the scan line of video data is supplied to the C-column electrodes $Y_{Cj}$ and the fourth row of the scan line of video data is supplied to the D-column electrodes $Y_{Dj}$. Accordingly, correct video data is displayed on the first to fourth rows of the picture cells on the display columns $Y_j$ to correspond to the arrangement of the picture cells of the matrix display panel 7 of FIG. 10.

During the fifth to eighth row periods of the scan line in which the first row electrode $X_1$ is selected and the first to fifth rows of the scan line of video data for the display columns $Y_j$ are displayed, the next video data, that is, the fifth to eighth rows of the scan line of video data, is supplied to the column electrode drivers 10 and 20.

As described above, in the sixth row period of the scan line, the sixth row of the scan line of video data appears first in the digital video signal $SD_3$ and the fifth row of the scan line of video data follows. At this time, the line memory write clock $CP_{CD}$ is generated so that the fifth and sixth rows of the scan line of video data are written into the line memory of the CD-column electrode driver 20.

In the eighth row period of the scan line, the eighth row of the scan line of video data appears first in the digital video signal $SD_3$ and the seventh row of the scan line of video data follows. At this time, the line memory write clock $CP_{AB}$ is generated so that the seventh and eighth rows of the scan line of video data are written into the line memory of the AB-column electrode driver 10.

When the fifth to eighth rows of the scan line of video data have been written into the line memories, the strobe pulse STB is generated so that the video data is latched and the second row electrode $X_2$ is selected during the ninth to twelveth row periods of the scan line. The video data is modulated into the column electrode drive signals $V_{YAj}$, $V_{YBj}$, $V_{YCj}$ and $V_{YDj}$ by the modulator, and the eighth row of the scan line of video data is supplied to the A-column electrodes $Y_{Aj}$, the seventh row of the scan line of video data is supplied to the B-column electrodes $Y_{Bj}$, and the sixth and fifth rows of the scan line of video data are supplied to the C-column electrodes $Y_{Cj}$ and the D-column electrodes $Y_{Dj}$, respectively. Thus, the fifth to eighth rows of the scan line of video data are displayed on the fifth to eighth rows of picture cells on the display columns $Y_j$ in a correct sequence.

It will be readily understood that the display operations for the picture cells on the ninth and following rows a repetition of the operations described above.

In the present embodiment, the signal connecting lines for the column electrodes $Y_{Aj}$-$Y_{Dj}$ and the column electrode drivers 10 and 20 do not cross.

EMBODIMENT 4

Figure 12:
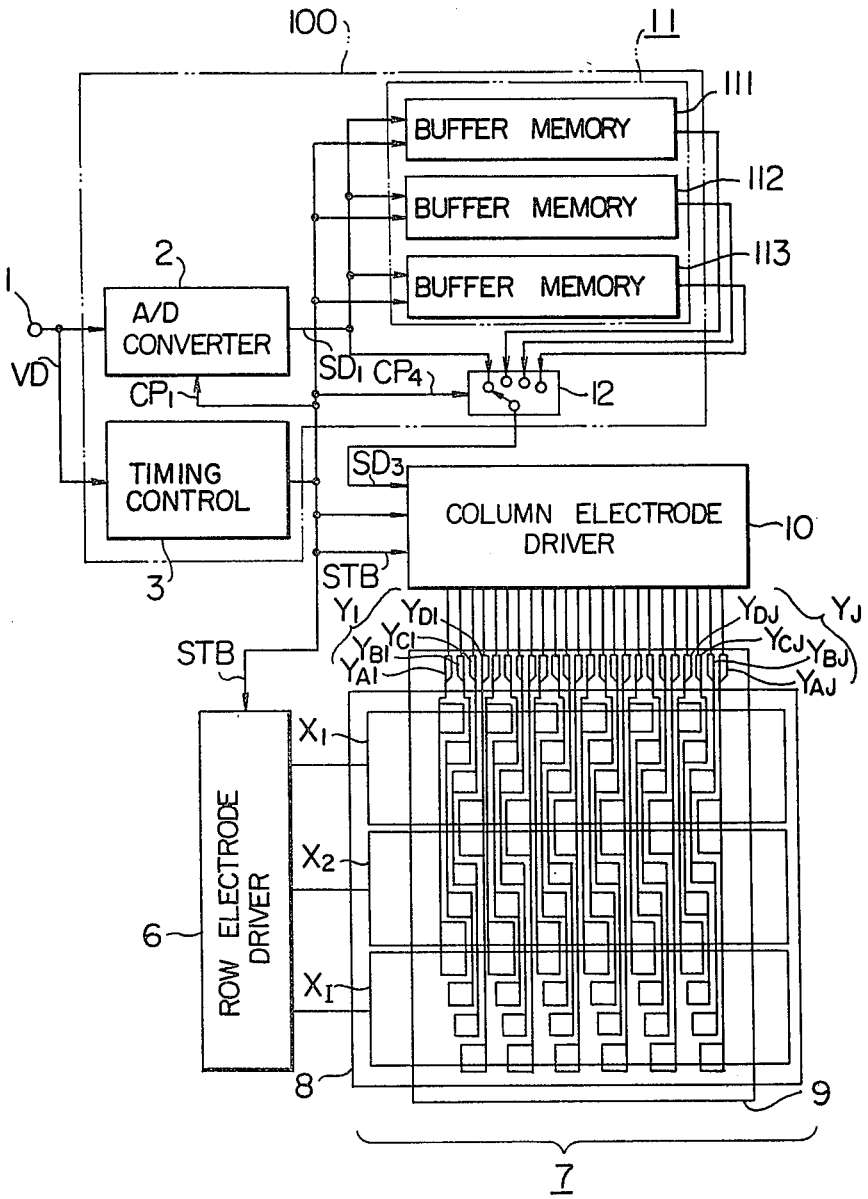
FIG. 12 shows a fourth embodiment of the liquid crystal matrix display device in accordance with the present invention.

Referring to FIG. 12, like numerals to those shown in FIGS. 6 to 10 denote the like or corresponding elements.

In the third embodiment shown in FIGS. 10 and 11, the column electrodes are arranged on opposite ends of the first substrate 9 of the matrix display panel 7. In the fourth embodiment shown in FIG. 12, all of the column electrodes $Y_{Aj}$-$Y_{Dj}$ are arranged on the same end of the first substrate 9 in the alternate quadruplex matrix display panel.

In FIG. 12, the column electrode driver 10 drives 4J column electrodes $Y_{Aj}$, $Y_{Bj}$, $Y_{Cj}$ and $Y_{Dj}$. The buffer memory 11 has three rows of capacity. In the (4i)th row (i=1, 2, . . . I) periods of the scan line, the (4i−3)th to (4i−1)th rows of the scan line of video data produced from the buffer memories 111, 112 and 113 and the (4i)th rows of the scan line of data produced from the A-D converter 2 are selected by the switch 12 and written into the line memory of the column electrode driver 10. The switch 12 is controlled by the switching clock $CP_4$ generated in the (4i)th row periods of the scan line so that the digital video signal $SD_3$ writes the (4i−3)th, (4i−2)th, (4i−1)th and (4i)th rows of the scan line of video data into the line memory in the (4i)th row period of the scan line. The video data is written into the line memory in a order of (4i−3) row, (4i−2)th row, (4i−1)th row, (4i)th row when i is odd, and (4i)th row, (4i−1)th row, (4i−2)th row and (4i−3)th row, when i is even. The strobe pulse STB is generated when the four rows of the scan line of video data have been written into the line memory.

Accordingly, when the odd row electrodes $X_1$ are selected, the (4i−3)th rows of the scan line of video data are supplied to the A-column electrodes $Y_{Aj}$, the (4i−2)th rows of the scan line of video data are supplied to the B-column electrodes $Y_{Bj}$, the (4i−1)th rows of the scan line of video data are supplied to the C-column electrodes $Y_{Cj}$ and the (4i)th rows of the scan line of video data are supplied to the D-column electrodes $Y_{Dj}$. When the even row electrodes $X_i$ are selected, the (4i)th rows of the scan line of video data are supplied to the A-column electrode $Y_{Aj}$, the (4i−1)th rows of the scan line of video data are supplied to the B-column electrodes $Y_{Bj}$, the (4i−2)th rows of the scan line of the C-column electrodes $Y_{Cj}$ and the (4i−3)th rows of the scan line of video signal are supplied to the D-column electrodes $Y_{Dj}$. In this manner, the video data is displayed in a correct order.

In the present embodiment, the signal connecting wires for the column electrodes $Y_{Aj}$–$Y_{Dj}$ and the column electrode driver 10 do not cross.

EMBODIMENT 5

Figure 13:
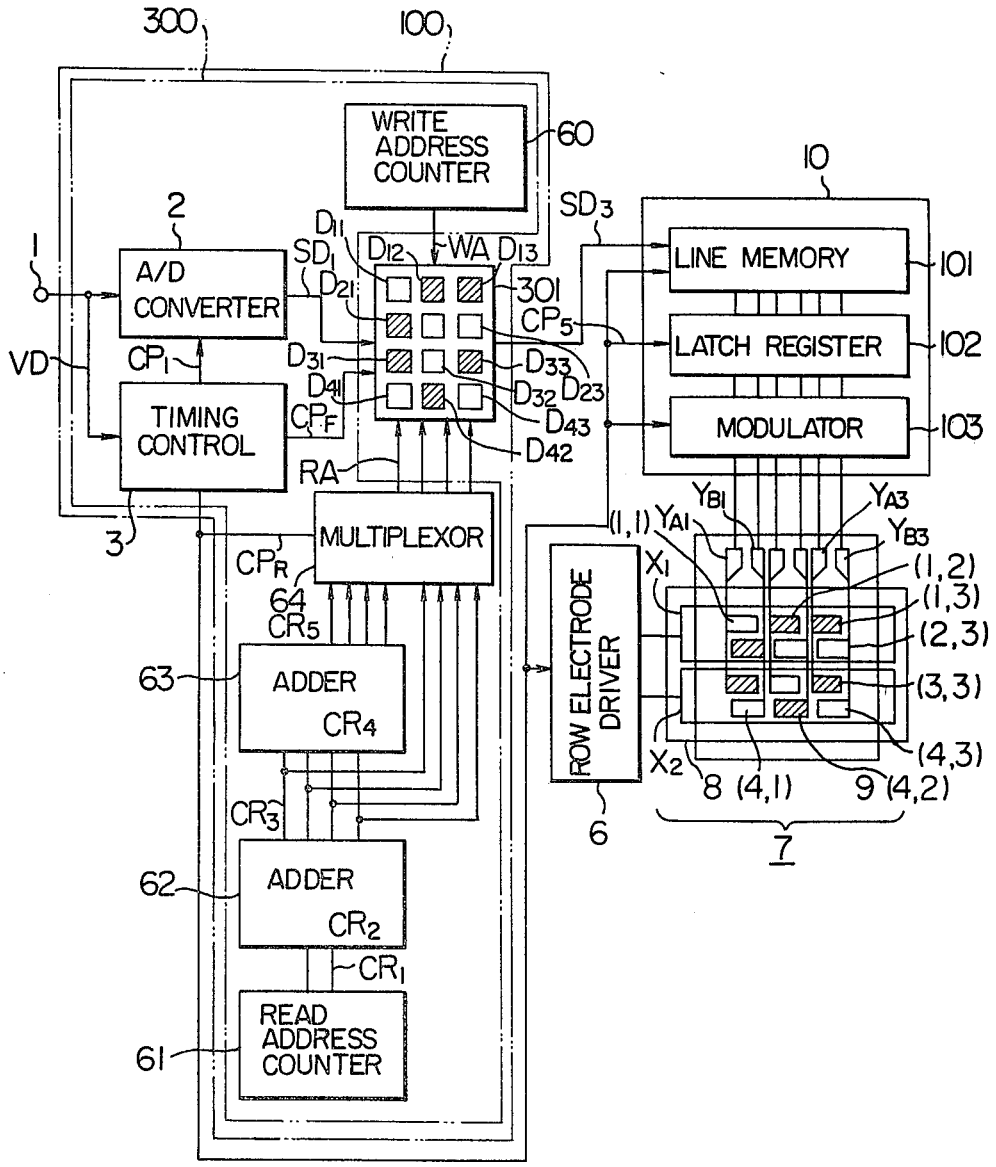
FIG. 13 shows a fifth embodiment of the liquid crystal matrix display device in accordance with the present invention.

FIG. 13 shows an embodiment having a frame memory for storing one frame of video data.

Referring to FIG. 13, the video data circuit 100 comprises a memory driver 300 and a frame memory 301. The memory driver 300 includes an A-D converter 2, a timing control circuit 3, a write address counter 60, a read address counter 61, adders 62 and 63 and a multiplexer 64. Like numerals to those shown in FIG. 6 denote like or corresponding elements. The matrix display panel 7 has four rows by three columns of picture cells (1.1), (1.2), . . . (4.3). A circuit operation for firing the hatched picture cells in FIG. 13 is specifically explained with reference to FIGS. 14*a* and 14*b*.

Figure 14A:
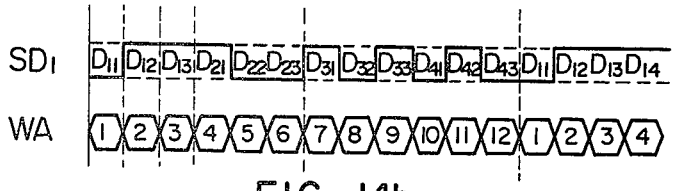
FIGS. 14*a* and 14*b* show time charts for explaining the operation of the fifth embodiment.

FIG. 14*a* illustrates a time chart for explaining the write operation of the frame memory. The video signal VD is converted to the digital video signal $SD_1$ by the A-D converter 2, and the video data $D_{11}$, . . . $D_{43}$ in one frame period corresponding to the picture cells (1.1), . . . (4.3) is stored in the frame memory 301 by the output signal WA from the write address counter 60.

Figure 14B:
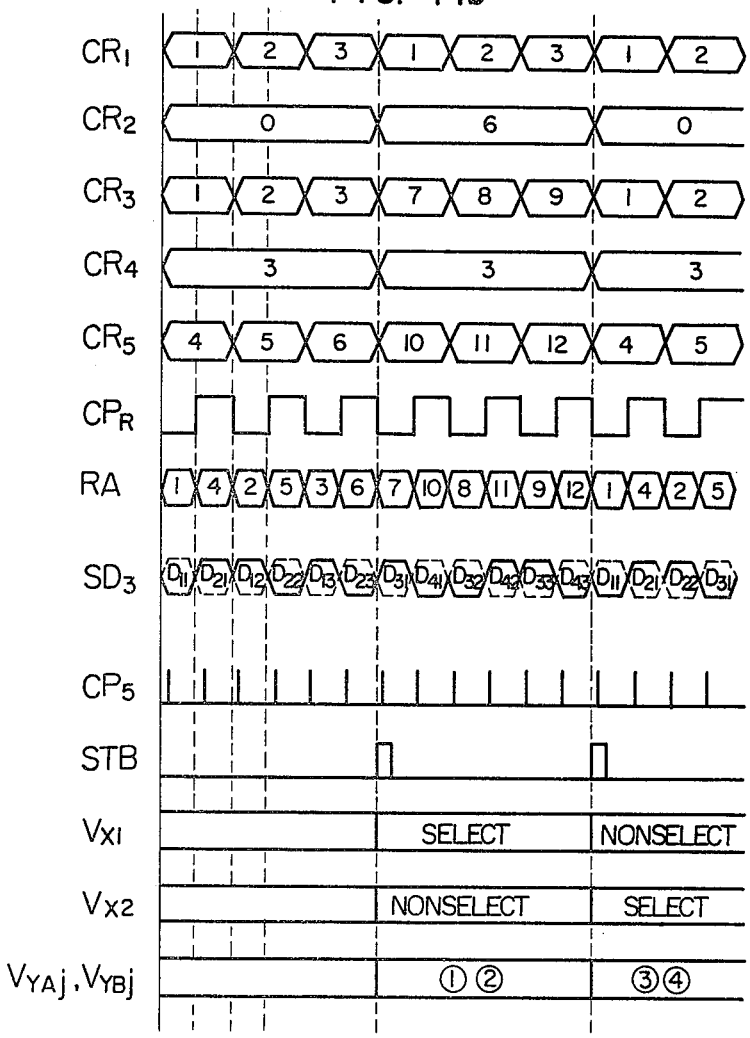

FIG. 14*b* illustrates a time chart for explaining the read operation of the frame memory. An output signal $CR_1$ of the read address counter 61 is combined with a signal $CR_2$ of the adder 62 to produce a signal $CR_3$. A portion of the output signal $CR_3$ of the adder 62 is combined with a signal $CR_4$ of the adder 63 to produce a signal $CR_5$. The output signal $CR_3$ of the adder 62 and the output signal $CR_5$ of the adder 63 are supplied to the multiplexer 64 where they are alternately selected by a switching pulse $CP_R$ to produce a read address signal RA. The video data $D_{11}$, $D_{21}$, $D_{12}$, $D_{22}$, $D_{13}$, $D_{23}$ at the addresses specified by RA form the digital video signal $SD_3$, which is then stored in the line memory 101. Then, the operation similar to that in the first embodiment shown in FIGS. 6 and 7 is carried out.

In the present embodiment, the signal connecting wires for the column electrodes $Y_{Aj}$ and $Y_{Bj}$ (j=1, 2, 3) and the column electrode driver 10 do not cross.

EMBODIMENT 6

Figure 15:
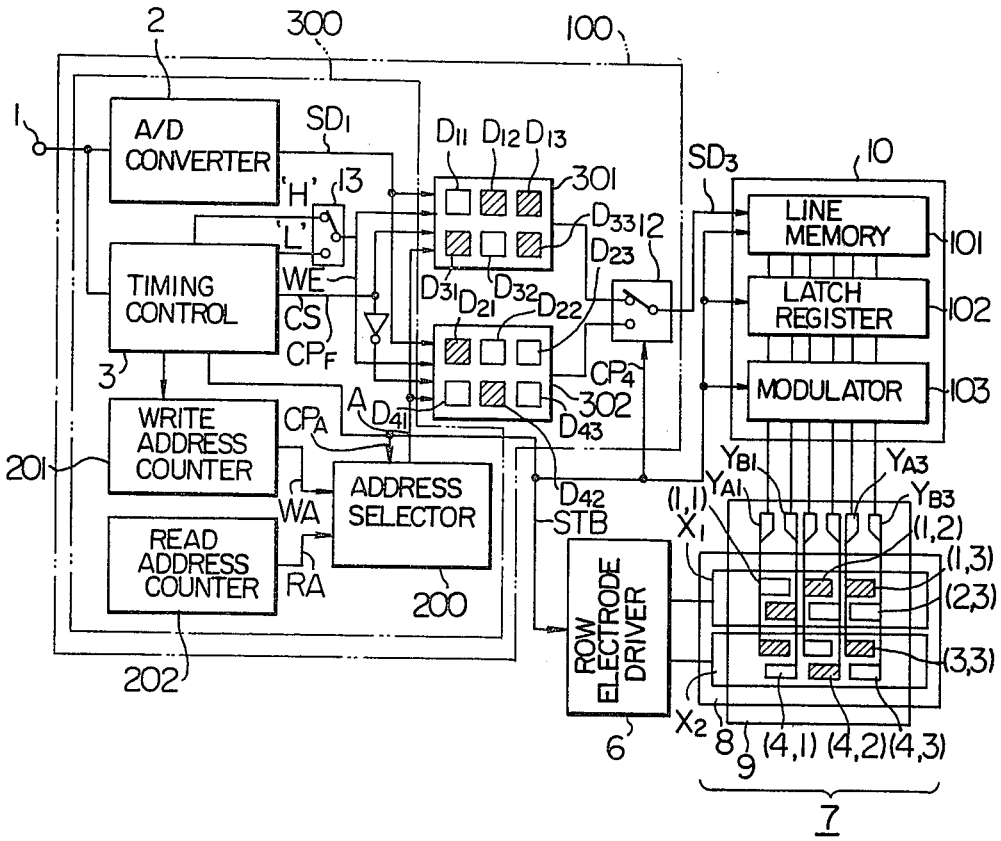
FIG. 15 shows a sixth embodiment of the liquid crystal matrix display device in accordance with the present invention.

Referring to FIG. 15, the video data circuit 100 comprises the memory driver 300, the frame memories 301 and 302 and the switch 12. The memory driver 300 includes the A-D converter 2, the timing control circuit 3, a switch 13, an address selector 200, a write address counter 201 and a read address counter 202. In FIG. 15, like numerals to those shown in FIGS. 6 and 13 denote like or corresponding elements.

In FIG. 15, the frame memories 301 and 302 are so divided that they correspond to the A-column electrodes $Y_{Aj}$ (j=1, 2, 3) and the B-column electrodes $Y_{Bj}$ of the matrix display panel 7. The first and third rows of the scan line of video data $D_{11}$, $D_{12}$, Dhd 13, $D_{31}$, Dhd 32, $D_{33}$ are stored in the frame memory 301 and the second and fourth rows of the scan line of video data $D_{21}$, $D_{22}$, $D_{23}$, $D_{41}$, $D_{42}$, $D_{43}$, are stored in the frame memory 302. The video data stored in the frame memories 301 and 302 is selected by the switch 12 and transferred to the line memory 101.

Figure 16A:
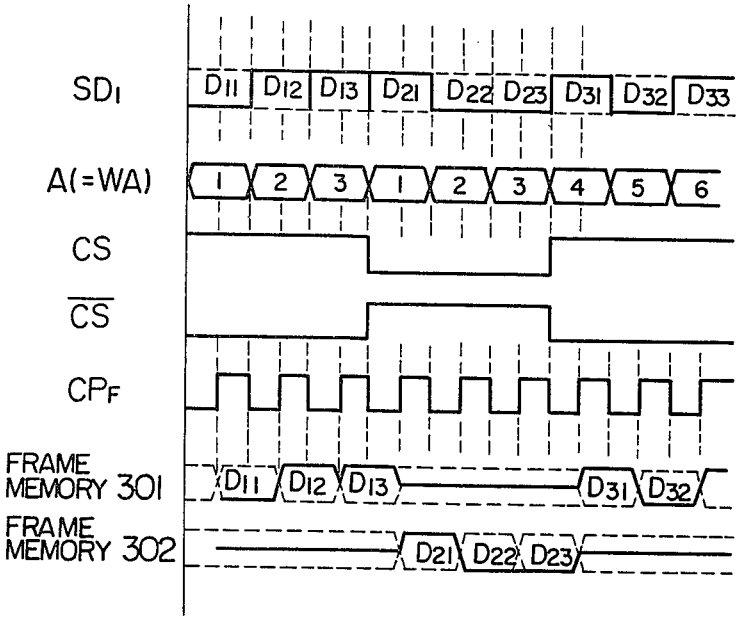
FIGS. 16*a* and 16*b* show time charts for the operation of the sixth embodiment.
Figure 16B:
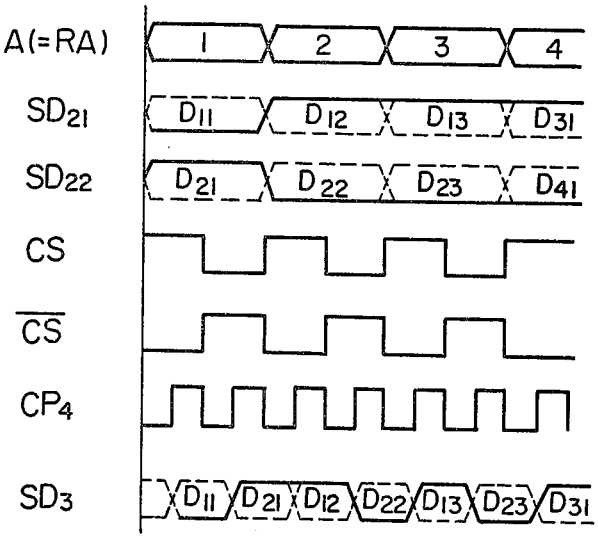

FIGS. 16*a* and 16*b* illustrate time charts for explaining the operation of FIG. 15. When a frame memory write/read control signal WE is logical "H", the data is written, and when it is "L" the data is read. When a chip select signal CS is logical "H", a chip is selected and the data is written at a leading edge of a frame memory write clock $CP_F$.

In the write operation, the switch 13 is thrown to the "H" position and the address selector 200 selects the write address signal WA at the output of the write address counter 201 by the control signal $CP_A$ to produce WA as an address output A. The write address signal WA is produced from a computer in the sequence as shown in FIG. 16*a* to specify the addresses in the frame memories 301 and 302 in synchronism with the digital video signal $SD_1$. The chip select signal CS defines a select block in the frame memory and it is generated at a timing as shown in FIG. 16*a* in the write operation. Accordingly, at the leading edge of the frame memory write clock $CP_F$, the first and third rows of the video data $D_{11}$, $D_{12}$, $D_{13}$, $D_{31}$, $D_{32}$, $D_{33}$ are stored in the frame memory 301, and the second and fourth rows of the video data $D_{21}$, $D_{22}$, $D_{23}$, $D_{41}$, $D_{42}$, $D_{43}$ are stored in the frame memory 302. The frame memory write pulse $CP_F$ is generated after the write address signal has sufficiently risen to enable the discrimination.

In the read operation, the write/read control signal WE in FIG. 15 is set to "L" and the address selector 200 selects a read address signal RA at the output of the read address counter 202 by the control signal $CP_A$ and produces RA as the address output A. The read address signal RA is produced in the sequence as shown in FIG. 16*b* at the double period of that of the digital video signal SD, to specify the addresses of the frame memories 301 and 302 in the read operation.

The chip select signal CS is generated at a timing as shown in FIG. 16*b* at one third of the period for the write operation and it forms a chip selection circuit together with a NOT circuit to select either the frame memory 301 or the frame memory 302. During the period of the read address signal RA, the switch 12 is switched by the clock pulse $CP_4$ so that the video data in the frame memories 301 and 302 are alternately transferred to the line memory 6 by the digital video signals $SD_{21}$ and $SD_{22}$. Accordingly, the digital image signal $SD_3$ includes $D_{11}$, $D_{21}$, $D_{12}$, $D_{22}$, $D_{13}$, $D_{23}$ in this sequence.

The operations from the parallel data conversion by the line memory 101 to the application of the voltages to the column electrodes are identical to those of the previous embodiment and hence the description thereof is omitted here.

Figure 17:
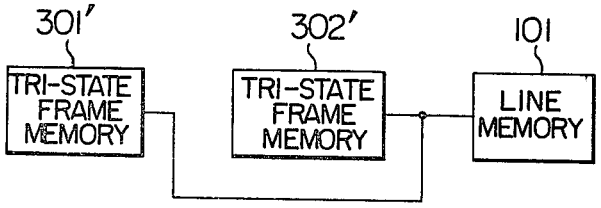
FIG. 17 shows a modification of the sixth embodiment.

In FIG. 15, the output signals of the frame memories 301 and 302 are selected by the switch 12. Where tri-state frame memories 301' and 302' are used as shown in FIG. 17, the switch 12 may be omitted.

In the embodiments of the present invention thus far described, multi-matrix or duplex, alternate duplex, and alternate quadruplex matrix systems have been explained. The present invention is also applicable to other multiplex matrix systems or alternate multiplex matrix systems or even a multi-stage matrix system having divided row electrodes so long as the column electrodes of each display column are electrically divided into a plurality of groups and the terminals of at least two groups of the divided column electrodes are arranged on the same side of the matrix display panel.

In the illustrated embodiments, the video signal VD is converted to the digital video signal $SD_1$ by the A-D converter 2. In a character display device which does not need gray levels, the digital video signal $SD_1$ may be a binary signal which discriminates black and white levels.

The memories such as the line memories and the buffer memory may be analog memories such as charge coupled device (CCD) memories. The inputs to the memories may be either digital signals or analog signals so long as they are video data signals. When an analog signal is used, the A-D converter may be omitted.

While all of the scan lines of the video signal VD are used for display in the illustrated embodiments, the present invention is equally applicable when every m-th row is used for display.

The switch 12 may be any electronic circuit which selects the video data and it may be constructed by logical gates.

The present invention is applicable to not only the liquid crystal display but also other displays such as electroluminescence display or plasma display.

As described hereinabove, according to the present invention, the signal connecting wires for the column electrodes and the column driver do not cross and the outputs of the column electrode driver and the column electrodes can be simply connected in one-to-one correspondence. Thus, a matrix display device which facilitates the wiring work can be provided.

We claim:

1. A matrix display device comprising:

a matrix display panel having a plurality of rows of row electrodes and a plurality of columns of column electrodes and a display medium interposed therebetween, crosspoints of said row electrodes and said column electrodes defining picture cells arranged in a matrix form, each of said column electrodes forming part of a respective single column of matrix picture cells and being divided into a plurality of groups of cell electrodes with a predetermined regularity, each group of cell electrodes being electrically interconnected within each column, and terminals of at least two groups of cell electrodes in each of said plurality of column electrodes being arranged to extend to the same side of said matrix display panel;

a row electrode drive circuit for producing row electrode drive signals to be applied to said row electrodes in accordance with received video data;

a column electrode drive circuit for producing column electrode drive signals to be applied to said two groups of cell electrodes in each column in accordance with said video data, outputs of said column electrode drive circuit being arranged in the same order as the arrangement of said terminals of said two groups of cell electrodes in each column; and a video data circuit for supplying said video data to said row electrode drive circuit and said column electrode drive circuit, including at least one memory for temporarily storing at least one row of picture cells of video data and switch means for producing a plurality of rows of picture cells of video data in one scan line period based on said one row of picture cells of video data stored in said memory and one adjacent row of picture cells of video data not stored in said memory.

2. A matrix display device comprising:

a matrix display panel having a plurality of rows electrodes and a plurality of column electrodes and a display medium interposed therebetween, crosspoints of said row electrodes and said column electrodes defining picture cells arranged in a matrix form, each of said column electrodes forming part of a respective single column of matrix picture cells and being divided into a plurality of groups of cell electrodes with a predetermined regularity, each group of cell electrodes being electrically interconnected within each column, and terminals of at least two groups of cell electrodes of said plurality of column electrodes being arranged to extend to the same side of said matrix display panel;

a row electrode drive circuit for producing row electrode drive signals to be applied to said row electrodes in accordance with received video data, a column electrode drive circuit for producing column electrode drive signals to be applied to said two groups of cell electrodes in accordance with said video data; and a video data circuit for supplying said video data to said row electrode driver and said column electrode driver, said video data supplied to said column electrode drive circuit being arranged in the same order as the arrangement of said terminals of said two groups of cell electrodes in each column, and including at least one memory for temporarily storing at least one row of picture cells of video data and switch means for producing a plurality of rows of picture cells of video data in one scan line period based on said one row of picture cells of video data stored in said memory and one adjacent row of picture cells of video data not stored in said memory.

3. A matrix display device according to claim 1 or 2, wherein said display medium is a liquid crystal.

4. A matrix display device according to claim 1 or 2, wherein said memory in said video data circuit includes a frame memory for storing one frame of video data at addressable storage locations and a memory drive circuit for driving said frame memory.

5. A matrix display device according to claim 4, wherein said frame memory is divided into a plurality of blocks equal in number to the number of said groups of said cell electrodes in each column.

6. A matrix display device according to claim 5, wherein said memory drive circuit includes means for sequentially specifying at least one of said plurality of blocks of said frame memory and means for specifying an address of a storage location in said selected block.

7. A matrix display device according to claim 1 or 2, wherein said matrix display panel defines n rows ($n \geqq 2$) of picture cells formed in part by each of said plurality of row electrodes, and wherein the picture cells in each column formed in part by the same row electrode belong to n different groups of cell electrodes.

8. A matrix display device according to claim 7, wherein the order of arrangement of 2 n rows by one column of picture cells formed in part by two adjacent row electrodes of said n different groups of opposing cell electrodes is reversed for each row electrode.

9. A matrix display device, comprising a display panel formed by a matrix of picture cells and having row electrodes, column electrodes and a display medium interposed therebetween, whereby the crosspoints of the rows and columns formed by said row electrodes and said column electrodes define said picture cells, each of said column electrodes being divided electrically into plural groups of interconnected cell electrodes, and terminals connected respectively to at least two groups of cell electrodes in each column are arranged at the same side of said display panel;

a row electrode drive circuit connected to said row electrodes to supply driving voltages thereto;

a column electrode drive circuit having a line memory and providing respective outputs connected to at least two groups of the cell electrodes in each column;

a buffer memory connected to receive from a video data input and temporarily store at least the video data of a single scan line; and switch means connected to said buffer memory and said data input for supplying said line memory alternatively with the video data from said video data input and said buffer memory so that the video data is arranged in said line memory with the respective cell data of plural adjacent scan lines interdigitated corresponding to the subdivision in groups of the connected cell electrodes in each column.

10. A matrix display device according to claim 9 characterized in that the sequence of the arrangement of cell electrodes of respective groups in the columns as defined by the subdivision of the column electrodes is reversed for successive row electrodes.

11. A matrix display device comprising a display panel formed by a matrix of picture cells and having row electrodes, column electrodes and a display medium interposed therebetween, whereby the crosspoints of the rows and columns formed by said row electrodes and said column electrodes define said picture cells, each of said column electrodes being divided electrically into plural groups of interconnected cell electrodes, and terminals connected respectively to at least two groups of cell electrodes in each column are arranged at the same side of said display panel;

a row electrode drive circuit connected to said row electrodes to supply driving voltages thereto;

a column electrode drive circuit having a line memory and providing respective outputs connected to at least two groups of the cell electrodes in each column;

a frame memory connected to receive from a video data input and store one frame of video data; and read-out means connected to said video data input and said frame memory for reading out video data from the frame memory to the line memory in a sequence so that the video data is arranged in the line memory with the respective cell data of plural adjacent scan lines interdigitated corresponding to the subdivision in groups of the connected cell electrodes in each column.

12. A matrix display device according to claim 11 characterized in that the frame memory is divided into a plurality of blocks equal in number to said different groups of cell electrodes in each column, and said read-out means includes means for selectively reading out the video data from the blocks and for supplying the read-out data to the line memory with the video data being arranged corresponding to the subdivision in groups of the connected cell electrodes in each column.

* * * * *